US005515808A

United States Patent [19]

Edlund

[11] Patent Number: 5,515,808

[45] Date of Patent: May 14, 1996

[54] ALERTING MECHANISM FOR A WHISTLE

[76] Inventor: Gary Edlund, P.O. Box 92, Meadow Vista, Calif. 95722

[21] Appl. No.: 271,423

[22] Filed: Jul. 7, 1994

[51] Int. Cl.[6] ..... G10K 5/00; A63H 5/00

[52] U.S. Cl. ..... 116/137 R; 116/222; 116/313; 446/205

[58] Field of Search ..... 116/137 R, 200, 116/223, 306, 307, 309, 319; 446/204–206, 216, 404; 84/330, 334, 453

[56] References Cited

U.S. PATENT DOCUMENTS

| | | | |
|---|---|---|---|
| 2,500,495 | 3/1950 | Mutch | 116/223 |
| 2,503,691 | 4/1950 | Sutphin | 116/223 |
| 2,737,757 | 3/1956 | Liebelt | 446/205 |
| 3,120,213 | 2/1964 | Mulligan | 116/137 R |
| 4,779,568 | 10/1988 | Finger, Jr. | 116/137 R |
| 5,002,006 | 3/1991 | Ehrenreich | 116/137 R |

*Primary Examiner*—William A. Cuchlinski, Jr.
*Assistant Examiner*—Andrew Hirshfeld
*Attorney, Agent, or Firm*—Bielen, Peterson & Lampe

[57] ABSTRACT

An alerting mechanism integrated with a hand-held whistle utilizing a structural member having a first and a second surface. The structural member is secured to the whistle or a cavity found in the whistle structure, to permit the structural member to rotate and be held between a first and a second position. The first position exposes the first surface of the structural member while the second position exposes the second surface of the structural member. Coloration or other marking may be employed on the first surface to visually distinguish the first surface from the second surface.

7 Claims, 1 Drawing Sheet

ALERTING MECHANISM FOR A WHISTLE

BACKGROUND OF THE INVENTION

The present invention relates to a novel and useful alerting mechanism integrated with a hand-held whistle.

Hand-held whistles are typically used in sporting events by arbiters or referees controlling the directional and flow of the sporting activity. Recent rule changes have been instituted in many sports to speed up the game being played. For example, in basketball, the jumpball situation has been eliminated by alternating possession between the opposing teams. It is, thus, a responsibility of the referee to keep track of the next possessor of the ball when a jumpball situation occurs.

Unfortunately, the referee in most sports, such as a basketball game, is required to be intimately involved with the game and to make numerous decisions concerning other aspects of the game. Remembering the team entitled to possession in a jumpball situation is often forgotten, requiring others to ascertain such status, which results in delaying the playing of the game and uncertainty.

An alerting device which reminds a referee in a game as to a future action, such as entitlement of ball possession and the like, would be a notable advance in the sports field.

SUMMARY OF THE INVENTION

In accordance with the present invention a novel and useful alerting mechanism useable in sporting events is herein provided.

The alerting mechanism of the present invention employs a conventional whistle and utilizes a structural member having a first surface and a second surface spaced from each other. The first and second surfaces may be marked or provided with indicia to distinguish one from another. The structural member may be composed of material which is compatible with a hand-held whistle normally used in a sporting event.

Mounting means is found in the present invention for rotatably mounting the structural member to the whistle. Thus, the structural member is rotatable relative to the whistle body into a first position exposing the first surface of the structural member for visual viewing of the same, or into a second position for exposing the second surface of the structural member for the same purpose. Such means for rotatably mounting the structural member may include a pivot or axle which spans a portion of the whistle. Such pivot may turn relative to the structural member or relative to the whistle body itself, in this regard.

The present invention also is formed with securing means for selectively holding or locking the structural member into the first or second positions. The securing means may take the form of a cam surface on the structural member and a spring element capable of exerting a force on the cam surface. In addition, the spring element may include a cam follower which is linked to a spring for contacting the cam surface. The cam surface of the structural member may include a corner which serves as the meeting place between the first and second surfaces. Thus, the first or second surface exposed in the first or second position, respectively, is maintained in that position during movement of the hand-held whistle, by pressure of the cam follower thereupon.

It may be apparent that a novel and useful alerting mechanism integrated with a hand-held whistle has been herein described.

It is therefore an object of the present invention to provide an alerting mechanism integrated with a whistle which is capable of providing a visual signal to a referee in a game in order to remember an event occurring during the game or to indicate a future decision in the game.

It is another object of the present invention to provide an alerting mechanism integrated with a hand-held whistle which is capable of being placed into existing whistle structures without affecting the sound qualities of the whistle.

A further object of the present invention is to provide an alerting mechanism integrated with a hand-held whistle that is simple and reliable in usage.

The invention possesses other objects and advantages especially as concerns particular characteristics and features thereof which will become apparent as the specification continues.

For a better understanding of the invention reference is made to the following detailed description of the preferred embodiments thereof which should be referenced to the prior described drawings.

DETAILED DESCRIPTION OF THE PREFERRED EMBODIMENTS

Various aspects of the present invention will evolve from the following detailed description of the preferred embodiments thereof which should be taken in conjunction with the prior described drawings.

Figure 1:
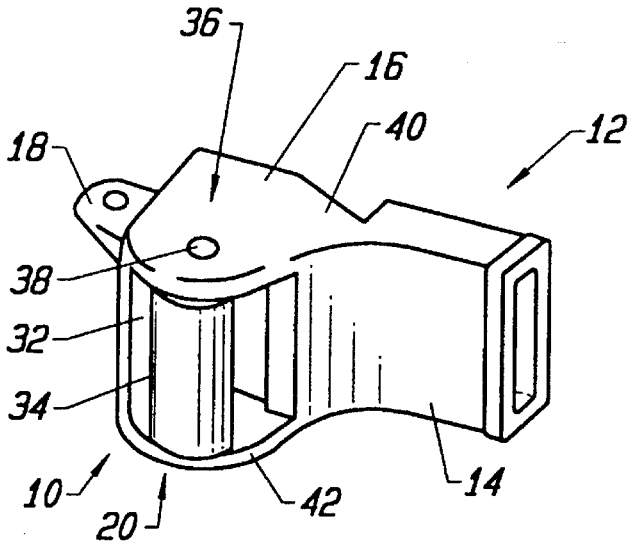
FIG. 1 is a perspective view of a whistle with the mechanism of the present invention depicted therein.

The invention as a whole is shown in the drawings by reference character 10. The alerting mechanism 10 is used in conjunction with a whistle body 12. Whistle 12 includes an entry portion 14 and a sound cavity 16. For example, whistle 12 depicted in FIG. 1 may be a Fox 40 Model manufactured by Fortron International, Inc., of Hamilton, Ontario, Canada. Whistle 12 may also be constructed of plastic material and include a tab 18 capable of accepting a lanyard or the like. Whistle 12 is typically used in a sporting event and is carried by the referee to control the flow of the game being played.

Figure 3:
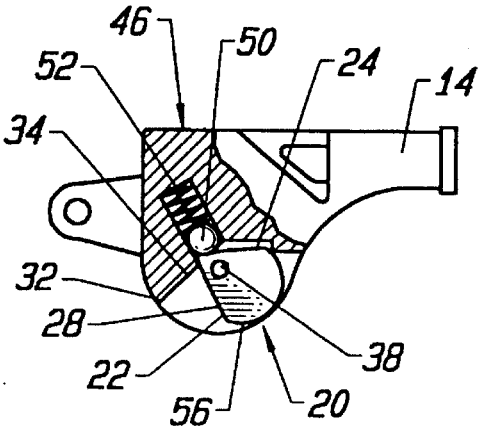
FIG. 3 is a side elevational view of a whistle with alerting mechanism of the present invention and the structural member thereof in another position.

Mechanism 10 includes as one of its elements structural member 20 which is depicted in the drawings as a rigid or semi-rigid elongated element. Structural member 20 possesses a first surface 22 and a second surface 24 which meet at a corner or edge 26. First surface 22 may include a marking such as paint, indicia, and the like to visually distinguish the same from second surface 24. In the present case, a paint layer 28 is indicated in FIG. 3 to achieve this result. Structural member 20 lies within a cavity 30 normally found on whistle 12. The cavity 30 is formed by a pair of substantially parallel walls or side portions 40 and 42. In this regard, surface 32 of cavity 30 also includes a paint layer 34 matching paint layer 28 of first surface 22 of structural member 20.

Figure 2:
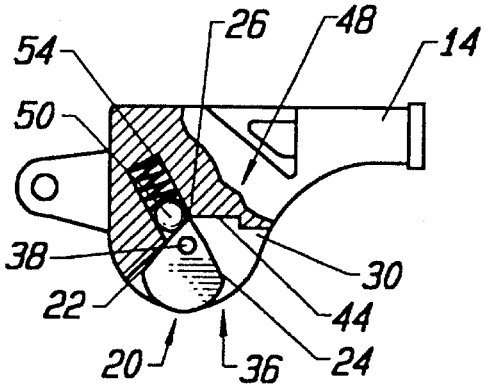
FIG. 2 is a side elevational view of the mechanism of the present invention integrated into a whistle with a broken away portion showing the structural member in one position.

Mounting means 36 is also included in the present invention for maintaining engagement of structural member 20 to whistle 12. Mounting means 36 includes a pivot pin 38 which extends through structural member 20 and is rotatably held to side portions 40 and 42 of whistle 12, FIG. 1. As depicted in FIGS. 2 and 3, structural member 20 rotates about pivot pin 38 to a first position, FIG. 3, to visually expose first surface 22 between side portions 40 and 42. Likewise, FIG. 2 depicts structural member being rotated into a second position visually exposing second surface 24 between side portions 40 and 42. It should be noted that first surface 22 and surface 32 of cavity 30 are visually distinctive of second surface 24 and surface 44 of cavity 30 by the paint layers 28 and 34 of first surface 22 and surface 32 of cavity 30, respectively or by the indicia.

Securing means 46 is also depicted in the drawings for selectively holding structural member 20 in either the first or second position. Securing means 46 may be deemed to include a cam surface 48 formed by first surface 22, second surface 24, and edge 26 of structural member 20. Cam follower 50, in the form of a sphere, is pressed into contact with cam surface 48, specifically either first surface 22 or second surface 24, by spring element 52 in the form of a coil spring. Spring element 52 lies in a bore 54 within whistle 12. Rounded surface 56 of structural member 20 conforms to the outer edge of side portions 40 and 42 of whistle 12 and is easily accessible by the user.

In operation, the user of mechanism 10, typically a referee in a game, presses a finger against surface 56 of structural member 20 and flips the same between the first and second positions illustrated in FIGS. 2 and 3. Securing means 46 maintains structural member 20 in either of these two positions. In the first position depicted in FIG. 3, surface 22 and layer 28, as well as cavity surface 32 having layer 34 are visually observable by the user. Flipping structural member to the second position depicted in FIG. 2 reveals second surface 24 of structural member 20 and surface 44 of cavity 30. Surface 24 and surface 44 may appear in the coloration format of the material of whistle 12 and structural member 20, and are, thus, distinguishable from the surfaces 22 of structural member 20 and surface 32 of cavity 30. Consequently, mechanism 10 alerts the referee as to the status corresponding the game being played. In the case of basketball, the first position illustrated in FIG. 3 may represent that the home team is entitled to possession of the ball when a jumpball situation next occurs. FIG. 2 would then represent that the visiting team is entitled to the ball in the same future situation. Securing means 46 maintains structural member 20 in either of the first or second positions represented in FIGS. 2 or 3 during the game playing time and is not accidentally moved between the first and second positions while the referee is traveling along the court of a playing field.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. An alerting mechanism integrated with a whistle having a body and also having an open cavity formed by a pair of substantially parallel walls projecting outwardly from the whistle body, said alerting mechanism comprising a. a structural member having a first surface and a second surface spaced from said first surface;

b. mounting means for rotatably maintaining engagement of said structural member to the whistle, said mounting means including a pin spanning between the pair of substantially parallel walls of the whistle, with at least a portion of said structural member positioned within the open cavity of the whistle, said mounting means permitting rotation of said structural member about an axis of the pin to a first position and a second position, said first position visually exposing said first surface between the pair of substantially parallel walls at the exterior of the whistle at the open cavity thereof, said second position visually exposing said second surface between the pair of substantially parallel walls at the exterior of the whistle at the open cavity thereof; and c. securing means for selectively holding said structural member in said first and second positions.

2. The alerting mechanism of claim 1 in which said securing means comprises said structural member including a cam surface and a spring element capable of exerting a force on said cam surface.

3. The alerting mechanism of claim 2 in which said spring element further comprises a spring and a cam follower linked to said spring for contacting said cam surface.

4. The alerting mechanism of claim 1 in which said first surface includes a visual marking thereupon.

5. The alerting mechanism of claim 1 in which said mounting means for rotatably maintaining engagement of said structural member to the whistle includes said pin engaging said structural member and rotatably engaging the whistle.

6. The alerting mechanism of claim 5 in which said pin lies within the cavity of the whistle.

7. An alerting mechanism integrated with a whistle, comprising:

a. a structural member having a first surface and a second surface spaced from said first surface;

b. mounting means for rotatably maintaining engagement of said structural member to the whistle to permit rotation of said structural member to a first position visually exposing said first surface for viewing at the exterior of the whistle and a second position for visually exposing said second surface for viewing at the exterior of the whistle; and c. securing means for selectively holding said structural member in said first and second positions, said securing means comprising said structural member including a cam surface and a spring element capable of exerting a force on said cam surface, said spring element further comprising a spring and a cam follower linked to said spring for contacting said cam surface.

* * * * *